United States Patent [19]

Pickles

[11] 4,170,847

[45] Oct. 16, 1979

[54] TAILGATE WINDOW REGULATOR

[75] Inventor: Joseph Pickles, Birmingham, Mich.

[73] Assignee: Ferro Manufacturing Corporation, Detroit, Mich.

[21] Appl. No.: 911,371

[22] Filed: Jun. 1, 1978

[51] Int. Cl.[2] ..... E05F 15/08

[52] U.S. Cl. ..... 49/349; 49/358; 49/362

[58] Field of Search ..... 49/40, 41, 227, 349, 49/358, 375

[56] References Cited

U.S. PATENT DOCUMENTS

| | | | |
|---|---|---|---|
| 1,591,497 | 7/1926 | Reeves | 49/362 X |
| 2,336,530 | 12/1943 | Chandler et al. | 49/349 |
| 3,449,861 | 6/1969 | Lecomte | 49/349 |
| 3,469,128 | 9/1969 | Cartier | 49/349 X |

FOREIGN PATENT DOCUMENTS

| | | | |
|---|---|---|---|
| 1244610 | 7/1967 | Fed. Rep. of Germany | 49/349 |

*Primary Examiner*—Kenneth Downey
*Attorney, Agent, or Firm*—Whittemore, Hulbert & Belknap

[57] ABSTRACT

A window regulator for the tailgate of an automotive vehicle having a well, and a window movable into and out of the well. Provided in the well are independent drive assemblies at opposite sides thereof, one of which includes a motor. A drive shaft interconnects the assemblies to insure synchronous operation thereof. Each assembly includes a pinion and guide means for slidably supporting the drive assemblies on the racks. The rotatable pinions associated with the drive means are in mesh with the racks so that a rotation of the pinions results in vertical movement of the drive assemblies on the racks. The drive assemblies are fixedly connected to the lower edge of the window.

6 Claims, 27 Drawing Figures

18
50
51
46
7
7
66
60
58

18
50
66
60

3
18
5
6
6
5
20
3
22

63
64
62a
46
62
58
56
61
52
48
54
22

63
18
66
46
48

60
38

FIG.9
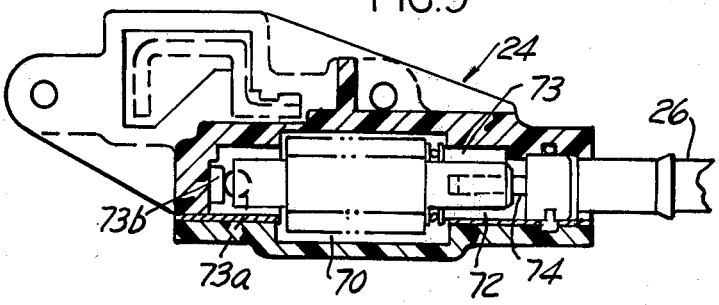
FIG.11
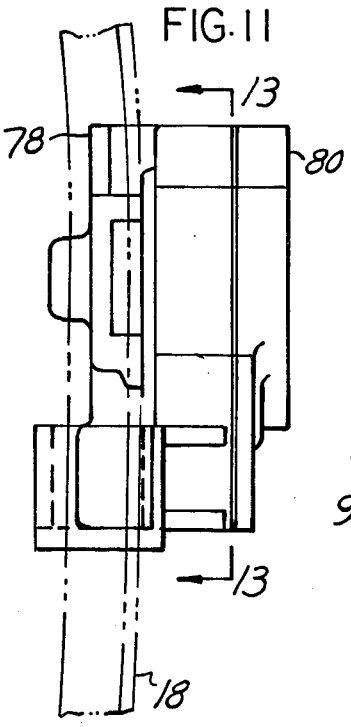
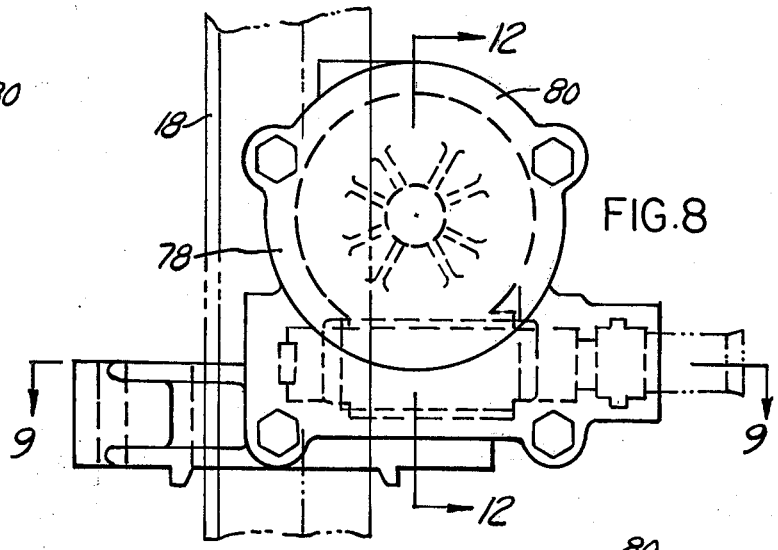
FIG.8
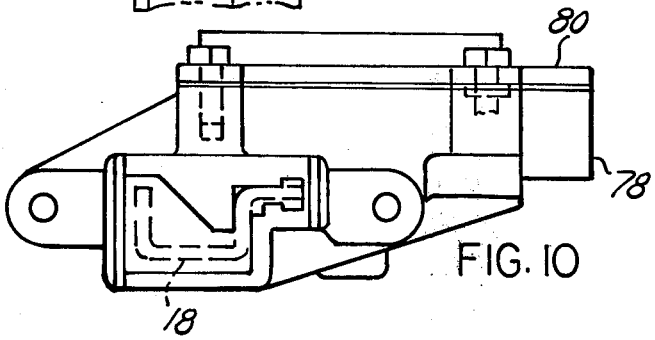
FIG. 10
FIG.12
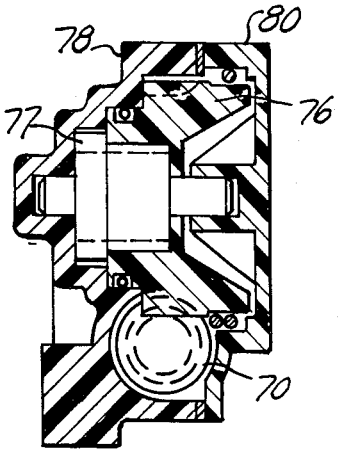
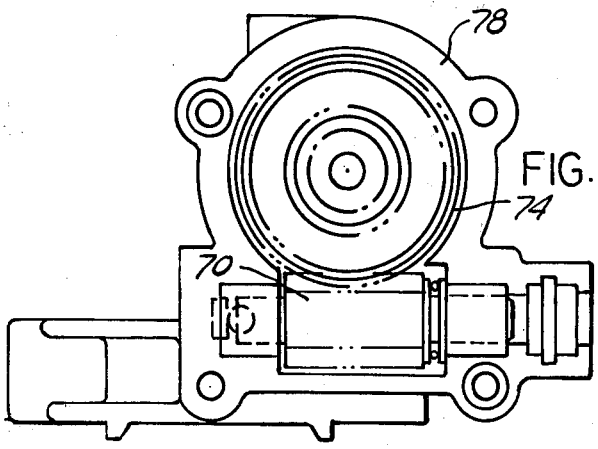
FIG.13

FIG. 20
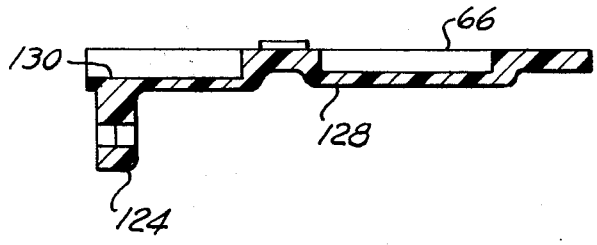
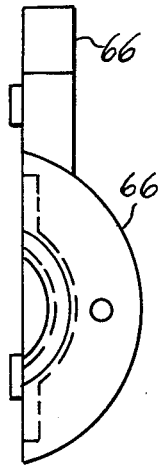
FIG. 22
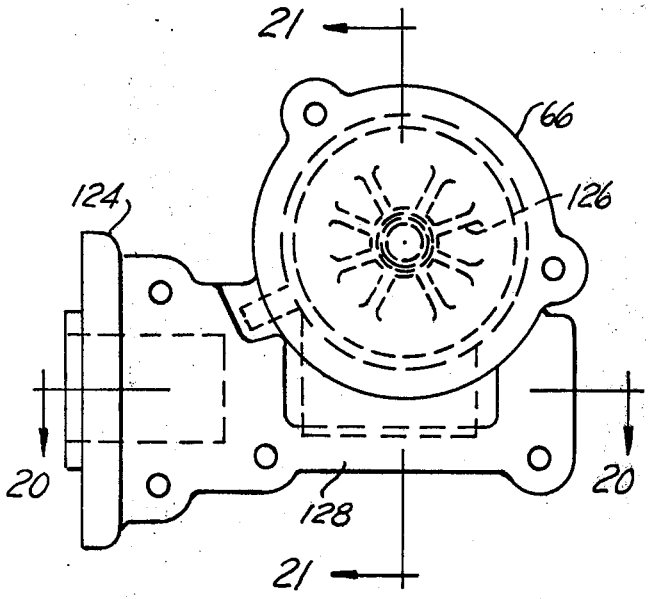
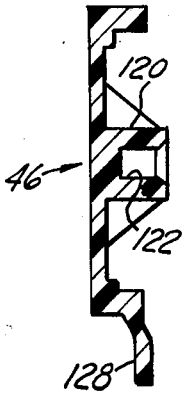
FIG. 21
FIG. 19

FIG. 24
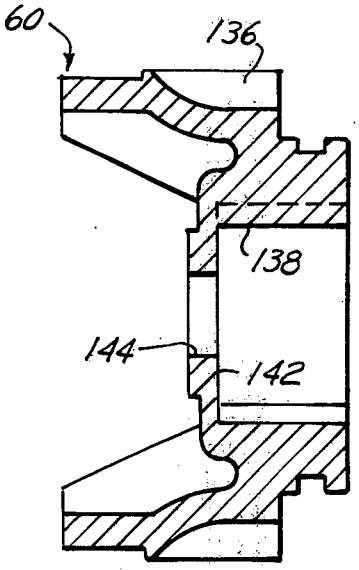
FIG. 23
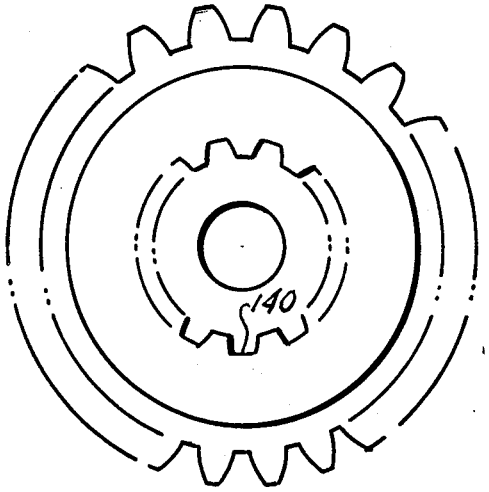
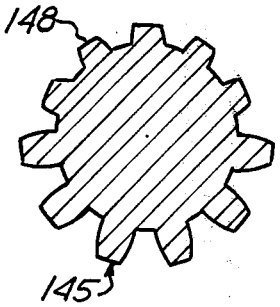
FIG. 26
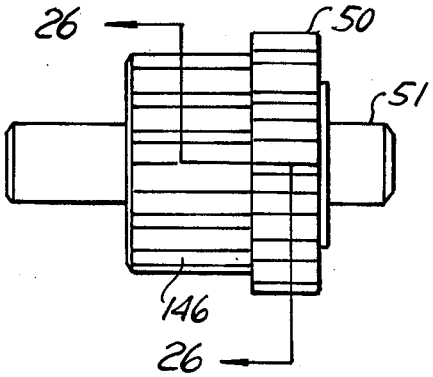
FIG. 25

TAILGATE WINDOW REGULATOR

BRIEF SUMMARY OF THE INVENTION

The present invention relates to a drive assembly for the window closure of the tailgate of a motor vehicle. At the present time vehicles such as for example station-wagons have tailgates which are movable between open and closed position. In some cases the tailgate is hinged at its lower edge for swinging upwardly and downwardly between open and closed position. In other cases the tailgate may be hinged to one side and movable outwardly and laterally to open positions. In either case the upper portion of the tailgate provides an opening into the interior of the vehicle when the tailgate is in closed position which is adapted to be selectively closed by a window closure.

The lower portion of the tailgate is hollow and provides a well in which the window is received when it is in open position with respect to the tailgate. Window regulating means are provided in the well and comprise a drive assembly including a motor at one side of the well, the assembly including a drive pinion and a guideway for cooperation with a rigid, generally vertical elongated rack. The drive assemblies include brackets for connecting them directly to the lower edge of the window. A somewhat similar drive assembly is provided in the well at the other side thereof but does not include a drive motor. Instead a drive shaft couples the two assemblies so that a pinion carried by the second or slave assembly rotates equally with the pinion of the first or master assembly.

The racks are formed of elongated strips of thin metal bent into channel shape for rigidity and have a flange extending laterally from the free edge of one side wall of the channel. The rack teeth are formed at the free edge of the flange and mesh with the associated pinion.

The guideways formed in the assembly include portions extending into the channel of the rack and engageable with the inner surface of the side wall from which the flange extends. The guideways further include slotted portions having opposing surfaces engageable with opposite sides of the flanges adjacent the roots of the rack teeth.

The assembly housings are formed of suitable plastic material such for example as acetal polymers which material may be readily shaped into the complex configurations required. It is a valuable feature of the present invention that when the assembly housings and covers are assembled together they provide bearing support surfaces for rotatable shafts without requiring separate bearings to be employed. Thus, the cost of the construction is materially reduced, and constructions are provided which are strong, long wearing and substantially silent in use.

From the foregoing it will be observed that the two racks on which the relatively wide window is vertically movable, are formed of relatively thin metal which are rendered substantially rigid by being formed into channel form. However, it will also be observed that the racks are solidly connected adjacent the upper and lower ends thereof to a rigid tailgate structure so that thereby the racks are provided in the form of functionally rigid stationary columns on which the two window drive assemblies are vertically movable.

The present application is related to my prior copending application Ser. No. 877,889, "Power Window Mechanism".

BRIEF DESCRIPTION OF THE DRAWINGS

FIG. 8 is a side elevational view of a slave drive assembly.

FIG. 9 is a section on the line 9—9, FIG. 8.

FIG. 10 is a bottom plane view of the structure of FIG. 8.

FIG. 11 is an end elevational view of the structure of FIG. 8.

FIG.12 is a sectional view on the line 12—12, FIG. 8.

FIG. 13 is a sectional view on the line 13—13, FIG. 11.

FIG. 19 is a side elevational view of the master transmission housing cover.

FIG. 20 is a sectional view on the line 20—20, FIG. 19.

FIG. 21 is a sectional view on the line 21—21, FIG. 19.

FIG. 22 is an end elevational view looking from the left in FIG. 19.

FIG. 23 is an end view of the worm gear.

FIG. 24 is an axial section through the worm gear shown in FIG. 23.

FIG. 25 is a side view of the pinion.

FIG. 26 is a sectional view on the broken line 26—26, FIG. 25.

DETAILED DESCRIPTION

Figure 1A:
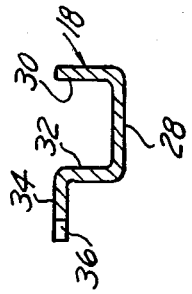
FIG. 1A is a sectional view through the rack.
Figure 1:
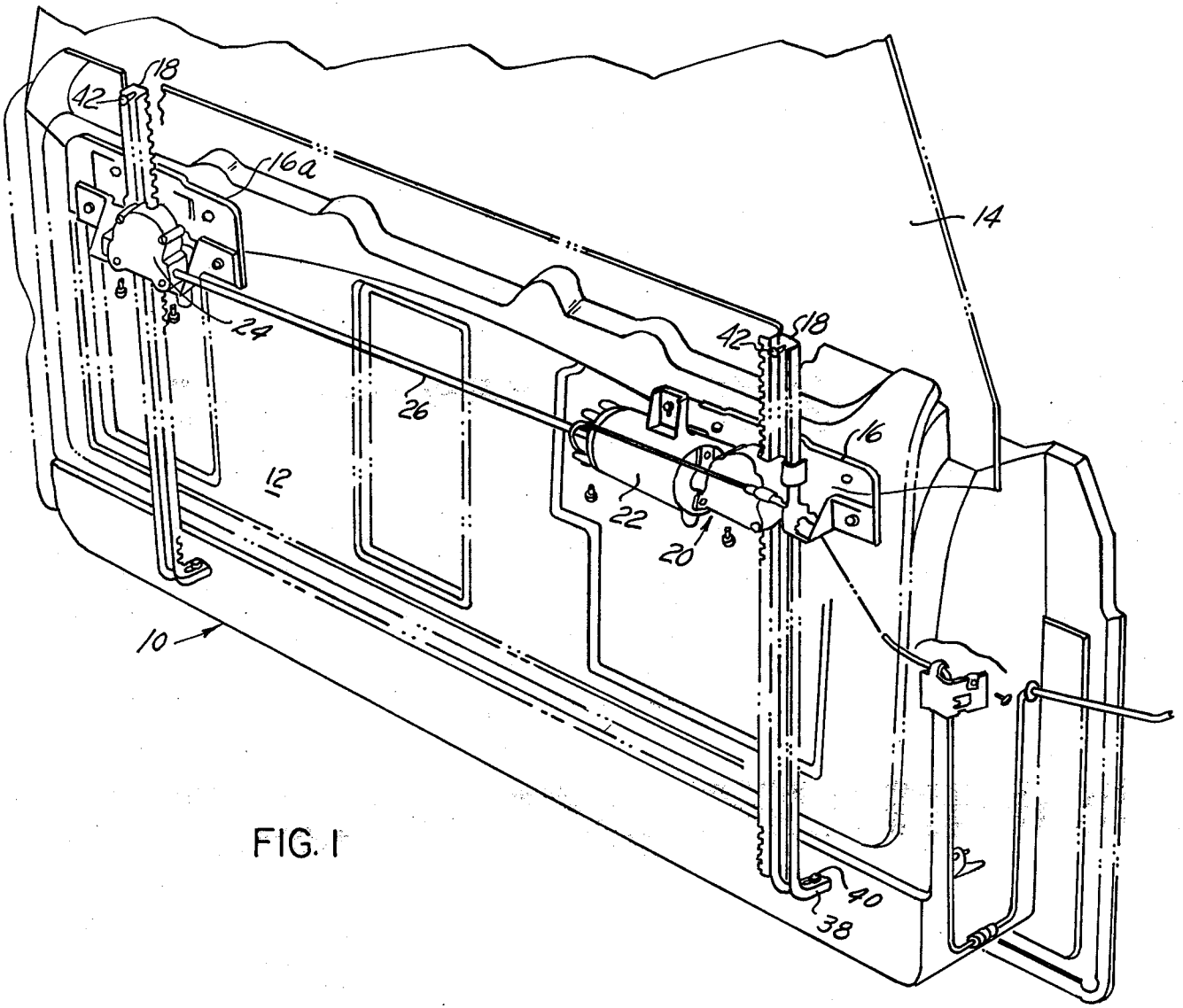
FIG. 1 is a fragmentary perspective view of the tailgate structure including the window and the drive mechanism associated therewith.

Referring first to FIG. 1 the lower portion of the tailgate 10 is illustrated in phantom exposing the window regulating mechanism within the well or housing structure 12. The vertically movable window is illustrated at 14 and is provided at its lower edge with brackets 16 and **16*a* by means of which it is connected to a pair of transmission assemblies vertically movable on racks 18. At the right side of the well as seen in FIG. 1 is a master transmission assembly indicated generally at 20 carried by the right hand bracket 16 and which includes an electrical motor 22. At the opposite side of the well is a generally similar slave transmission assembly 24 but this is not provided with an electric motor. Instead assemblies 20 and 24 are suitably connected by a drive shaft 26** which insures synchronous operation thereof.

The racks 18 are of similar construction although the tooth flange portions are provided at opposite sides of the two racks. The cross sectional shape of the rack is best illustrated in FIG. 1A in which it will be seen that the rack 18 is formed of an elongated strip of thin metal bent into a channel configuration providing a bottom wall 28 and sidewalls 30 and 32. One of the sidewalls, the sidewall 32 as shown in FIG. 1A, is provided with a laterally extending flange 34 provided with rack teeth as indicated at 36. The bottom ends of the racks are bent as indicated at 38 and are fixedly connected by suitable means such as screws 40 to the bottom of the well. The upper end of the racks are also fixedly connected to the upper end of the tailgate adjacent the upwardly open slot through which the window moves. Suitable fastener means such as screws 42 are provided to connect the upper ends of the rack 18 to portions of the tailgate adjacent the slot at the upper end of the well through which the window 14 is movable.

With this construction it will be apparent that when the motor 22 is energized it will drive a pinion not so far described, in mesh with the rack 18 at the right hand side of the tailgate as viewed in FIG. 1. An elongated drive shaft 26 which is torsionally rigid although it may be flexible, interconnects the master transmission assembly 20 with the slave transmission assembly 24 so that a further pinion in the slave transmission will be rotated synchronously with the pinion in the master transmission. The two transmission assemblies are slidable vertically on the racks 18, the upper and lower ends of which are fixedly mounted to impart columnlike rigidity thereto. Each of the transmission assemblies 20 and 24 is rigidly connected to the brackets 16 and **16*a* which are secured to the lower end of the window 14. It will be observed that the brackets 16 and 16*a*** are elongated and are thus capable of supporting the transmission assemblies for guided vertically sliding movement on the racks as the transmission assemblies and window move vertically to position the window above the tailgate well or to house the window within such well.

Referring now to FIGS. 2 through 7, there is a more complete disclosure of the master transmission assembly 20. As seen in this figure the master transmission assembly housing 46 includes a flange 48 by means of which it is rigidly coupled to the electric drive motor 22. The transmission for driving a pinion 50 maintained on a shaft 51 includes a flexible drive coupling 52 connecting one end of the motor shaft 54 to shaft 56 of a worm 58 which is in driving engagement with a worm gear 60, details of which will be subsequently described.

The shaft 51 at one end is journaled in a bushing 61 and its other end is recessed to receive a ball 62 which engages a hardened steel thrust plate **62*a***.

The pinion 50 is rigidly connected to the worm gear 60 as will subsequently be described. Accordingly, rotation of the motor 22 in either direction drives the pinion 50 in a corresponding direction and results in movement of the master transmission assembly 20 substantially vertically on the associated rack 18.

In order to house the elements of the gear transmission and also to provide for guiding the transmission housing in vertically sliding movement on the rack, the transmission housing is provided at its end opposite the flange 48 with an extension 63 having a vertically extending guideway indicated generally at 64 which will guide the master transmission substantially vertically on the rack 18.

The master transmission housing 46 is provided with a removable cover 66 which will subsequently be described in detail. It will be observed that the housing proper and its cover form housing structure providing cavities which house the worm gear and pinion.

Referring now more particularly to FIGS. 8 through 13 there is illustrated the slave transmission assembly indicated generally at 24. This slave transmission is generally similar to the master transmission assembly except that it is not provided with its own motor. Instead the slave transmission assembly includes a worm 70 having a shaft portion 72, one end of which is received in a bushing 73 and is directly connected to the transverse drive shaft 26 previously referred to by a coupling pin 74.

The opposite end of the shaft 72 is recessed to receive a ball **73*a* which engages a thrust plate 73*b* to take the longitudinal thrust of the worm 70**.

Accordingly the worm 70 is driven in synchronism with the worm 38.

The worm 70 is in driving relationship to a worm gear 76 which is splined or otherwise rigidly connected to the slave pinion 77 which meshes with the adjacent generally vertical rack 18.

Accordingly the pinions 50 and 77 are driven in synchronism so that as the motor is energized in either direction the assemblies made up of the window, the brackets 16 and **16*a* and the transmission assemblies 20 and 24 move up and down on the racks 18** as a unit.

The slave transmission comprises a main housing 78 having suitable cavities therein for the reception of the worm 70, the worm gear 74 and the pinion 77, which are closed by a removable housing cover 80 to form cavities in which the transmission elements are housed.

Referring now to FIGS. 14 through 18, details of the master transmission housing are illustrated.

Figures 2, 3, 4, 5, 6, 7:
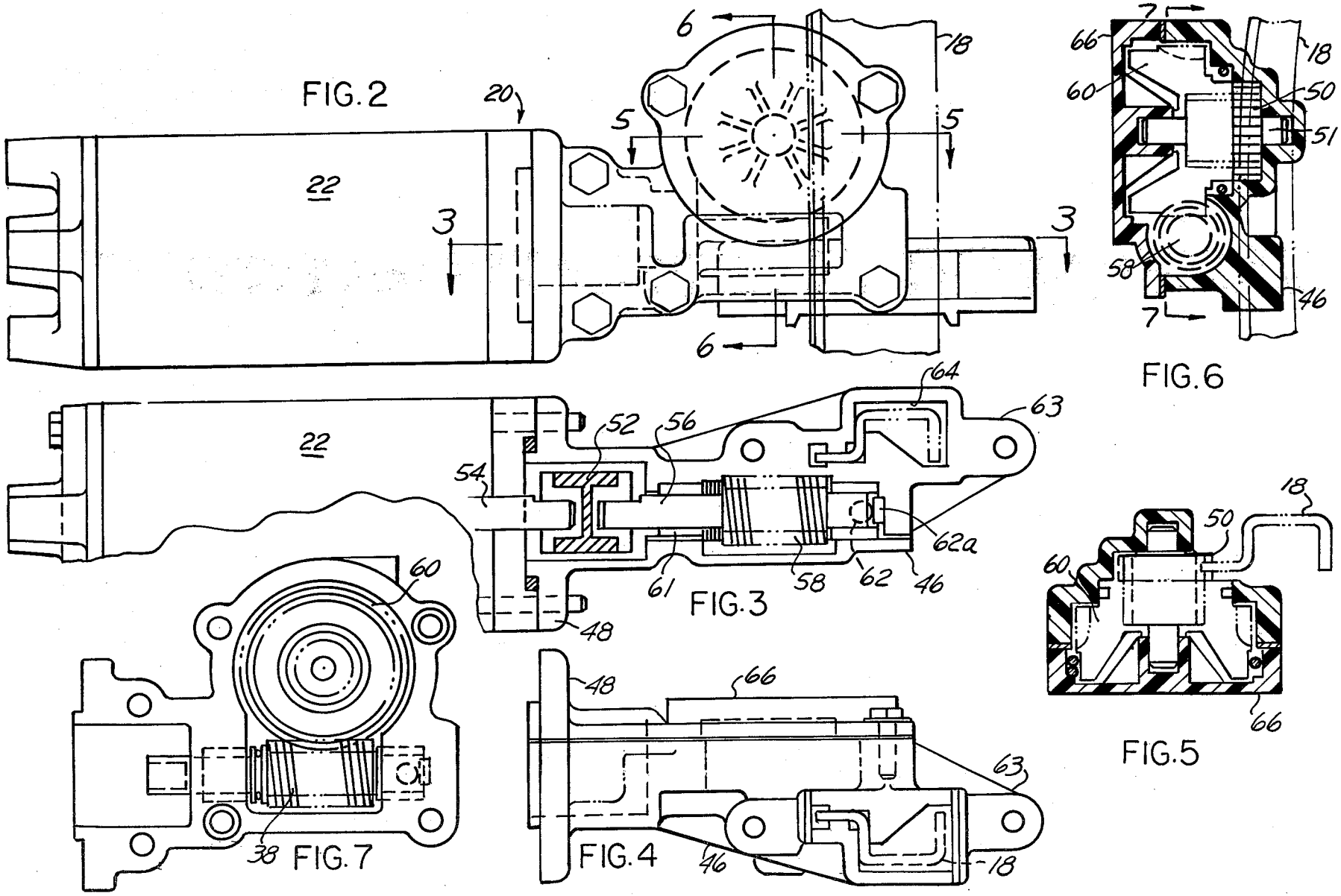
FIG. 2 is a side elevational view of a master drive assembly.
FIG. 3 is a section on the line 3—3, FIG. 2.
FIG. 4 is a partial bottom plan view of the structure shown in FIG. 2.
FIG. 5 is a sectional view on the line 5—5, FIG. 2.
FIG. 6 is a sectional view on the line 6—6, FIG. 2.
FIG. 7 is a sectional view on the line 7—7, FIG. 6.
Figure 15:
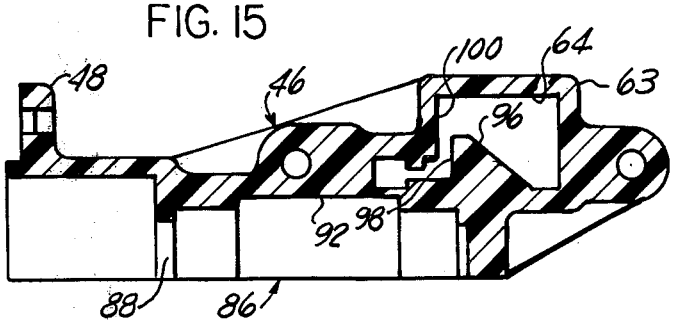
FIG. 15 is a sectional view on the line 15—15, FIG. 14.
Figure 18:
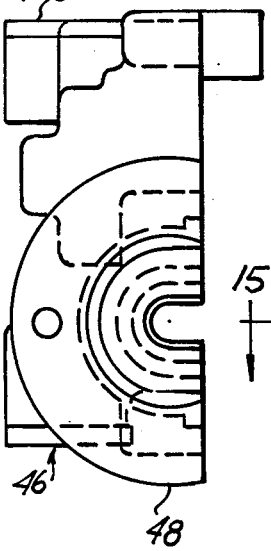
FIG. 18 is an end elevational view looking from the left in FIG. 14.
Figure 14:
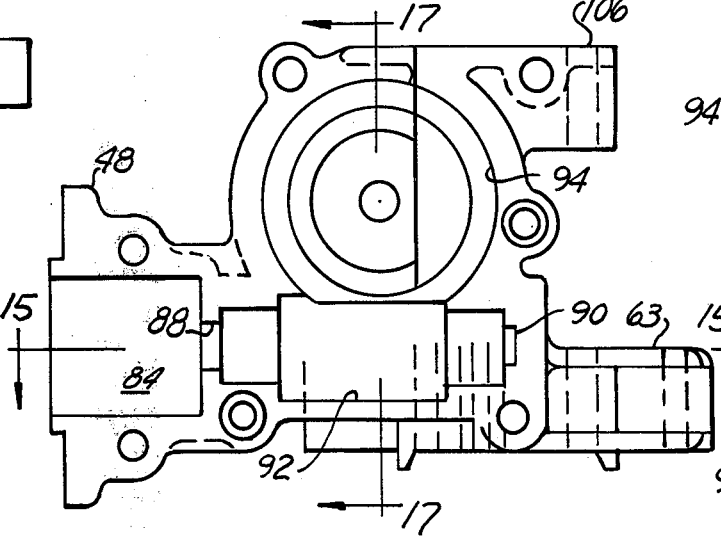
FIG. 14 is a side elevation of the master transmission housing.

The master transmission housing 46 is formed of a suitable low friction polymer such for example as an acetal polymer sold under the designation Delron 500 acetal homopolymer. It may readily be formed into a complex shape required for the transmission housing and at the same time provide a strong, low friction support for rotatable elements such as the pinion shaft. The master housing 46 includes at one end an enlarged chamber 84 which receives the coupling 52 previously described. The housing 46 includes a generally laterally opening recess 86 which includes a reduced portion 88 through which extends one end portion of shaft 52 as seen in FIG. 3. The recess also includes a further recessed portion 90 which is adapted to receive the thrust block **62*a* as best seen in FIG. 3 which is engageable by the ball 62** as previously described.

The recess 86 also includes an enlargement 92 for the reception of the worm. The enlargement 92 is in communication with a cavity 94 for the reception of the worm gear 60 which is mesh with the worm 92. The extension 63 has the guideway 64 which is composed essentially of vertical flat surfaces as will now be described. The inward projection 96 of the guideway includes a flat surface 98 adapted to be received within the channel of the rack and to bear against the inner surface of the wall 32 as best seen in FIG. **1*a*. This supports the toothed flange 34 in mesh with the drive pinion associated therewith. The guideway also includes a flat surface 100 which is adapted to engage the outer surface of the channel wall 32**.

Figure 16:
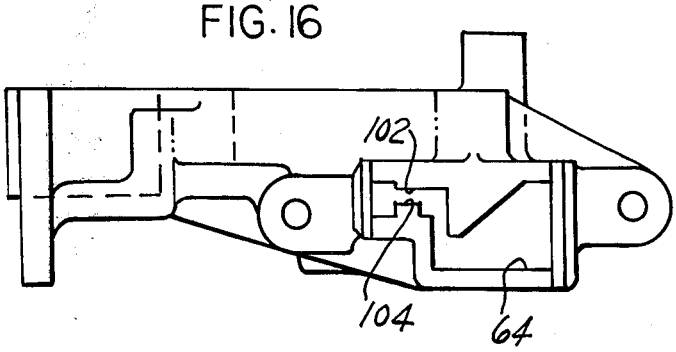
FIG. 16 is a bottom elevational view of the structure of FIG. 14.

Finally, the guideway 64 includes the flat surface 102 and 104 as designated in FIG. 16 which engage opposite sides of the rack flange 34. The bottom wall 28 and the outer wall 30 of the flange channel are unsupported as is perhaps best illustrated in FIG. 4.

The housing 46 includes mounting flanges 106 and 108 for rigid connection to the window bracket 16 previously described.

Figure 17:
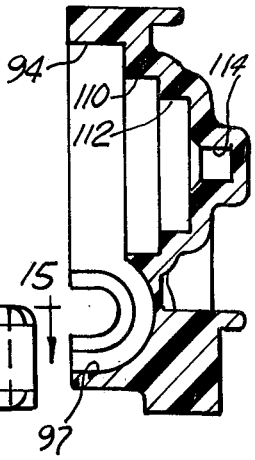
FIG. 17 is a sectional view on the line 17—17, FIG. 14.

Cavity 94 as best seen in FIG. 17 includes reduced portions 110 and 112 to receive the pinion 50, and a further blind recess 114 adapted to receive one end of the pinion support shaft 51. It will be observed that the recess or socket 114 supports the shaft 51 directly and requires no bearing or bushing, due to the physical characteristics of the material from which the housing 46 is fabricated.

Referring now to FIGS. 19 through 22 there is illustrated the cover 66 which is associated with the master transmission housing 46. The cover 46 at its inner surface includes a projection 120 having a blind recess 122 for the reception of the other end of the pinion shaft 51, as best illustrated in FIG. 6. The cover also includes a flange portion 124 which assists in coupling the master transmission assembly with the motor 22. The main portion 126 of the cover encloses the worm gear 60 as best illustrated in FIG. 6 and an edge portion 128 forms a closure for the cavity 92 in the main housing which receives the worm, a relationship also best illustrated in FIG. 6. An end of the cover 66 is recessed as indicated at 130 to complete the enclosure of the cavity or recess 84 provided in the main housing.

Referring now to FIGS. 23 through 26 details of the pinion 50 and the worm gear 60 are illustrated.

As seen in FIGS. 23 and 24, the worm gear is formed of a suitable low friction polymer such for example as the acetal resin used in forming the transmission housings and covers. The worm gear is provided at its outer periphery with a multiplicity of gear teeth 136 adapted to mesh with the teeth of the driving worm 58 or the corresponding worm in the slave assembly.

The worm gear 60 at one side has a recess 138 provided with spline teeth 140. The recess 138 is partially closed by a radial flange 142 having an opening 144 through which the pinion shaft 51 extends.

Referring now to FIGS. 25 and 26 the pinion assembly is seen to comprise a shaft 51 having the intermediate enlargement on which the pinion 50 is provided by suitably cutting the pinion teeth 145 thereon. The spline portion of the pinion 50 is indicated at 146 in which spline teeth 148 may conveniently be stub portions of the pinion teeth. The spline portions of the worm gear and pinion interfit so that rotation of the worm gear is imparted directly to the pinion. The parts may desirably be assembled with a press fit.

What is claimed is:

1. A vehicle tailgate window regulator, in which the tailgate includes a well in its lower portion and a full width window movable between a position in which it is fully housed within the well, and an upper position in which it closes an opening into the vehicle above the well, said regulator comprising a pair of substantially vertical racks fixedly mounted within the well at opposite sides thereof, a master drive assembly rigidly connected to the lower edge of the window adjacent one side thereof, said master drive assembly comprising a motor and a pinion connected to said motor and in mesh with the adjacent rack and a first guideway slidable on such rack, a slave drive assembly rigidly connected to the lower edge of the window adjacent the other side thereof, said slave drive assembly comprising a pinion in mesh with the rack adjacent thereto and a second guideway slidable on such rack, means including a drive shaft extending between said drive assemblies to insure synchronous rotation of said pinions and smooth vertical movement of the window, in which the means connecting said motor to said drive pinion comprises a worm directly connected to said motor, a worm gear in mesh with said worm, a spline connection between said worm gear and pinion, said master drive assembly comprising a unitary plastic housing having an end shaped for attachment to a motor housing and an opposite end having an apertured projection in which the aperture is shaped to form said guideway to support and guide said housing on one of said racks, said housing having a recess open at one side to receive said worm and a shaft therefor, said housing having an opensided cavity shaped to receive said worm gear and the pinion connected to said worm gear, said cavity having an opening to said guideway through which said rack extends for meshing engagement with the associated pinion.

2. A regulator as defined in claim 1, comprising in addition a unitary plastic cover having portions complementary to said housing shaped to close the side of said recess and to partly close said cavity to provide therewith a bearing support for said worm gear and pinion.

3. A regulator as defined in claim 2, in which said pinion comprises a shaft with projecting ends respectively received in bearing support recesses formed in said housing and said cover.

4. A regulator as defined in claim 3, in which said worm gear is formed of a plastic material and is provided with an internal spline formation, and said pinion has at one end a similar external spline formation by which it is coupled to said worm gear.

5. A vehicle tailgate window regulator, in which the tailgate includes a well in its lower portion and a full width window movable between a position in which it is fully housed within the well, and an upper position in which it closes an opening into the vehicle above the well, said regulator comprising a pair of substantially vertical racks fixedly mounted within the well at opposite sides thereof, interconnected master and slave drive assemblies connected to the opposite bottom end portions of the window, each drive assembly comprising a worm and worm gear, said worms being in axial alignment, a drive shaft directly interconnecting said worms, a pinion connected directly to each of said worm gears, said pinions being in mesh with said racks, a motor connected to the worm of said master drive assembly, each of said assemblies comprising a plastic housing structure having cavities in which said worm, worm gear and pinion are housed, said housing structures each having an end portion provided with an aperture shaped to interfit with the associated rack and to constitute a guideway slidable longitudinally on the associated rack, the cavities which receive said pinions having openings through which the tooth portions of said racks extend into meshed engagement with said pinions.

6. A regulator as defined in claim 5, in which said racks are in the form of elongated metal strips bent into channel shape and having a toothed rack-forming flange extending laterally from the free edge of one side wall of the channel, the apertures in each of said housing structures including a guide portion extending into said channel and engaging the inner surface of said one side wall.

* * * * *